US008601910B2

(12) United States Patent
Begnaud

(10) Patent No.: US 8,601,910 B2
(45) Date of Patent: Dec. 10, 2013

(54) TUBULAR JOINING APPARATUS

(75) Inventor: Brian D Begnaud, Youngsville, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 385 days.

(21) Appl. No.: 12/852,194

(22) Filed: Aug. 6, 2010

(65) Prior Publication Data

US 2011/0030512 A1 Feb. 10, 2011

Related U.S. Application Data

(60) Provisional application No. 61/207,891, filed on Aug. 6, 2009.

(51) Int. Cl.
*B25B 17/00* (2006.01)

(52) U.S. Cl.
USPC ..... 81/57.16; 81/57.2; 81/57.33; 81/57.34; 166/77.51; 166/77.53

(58) Field of Classification Search
USPC ..... 81/57.15–37.35; 173/164; 175/162; 166/77.51, 85.1, 77.53
See application file for complete search history.

(56) References Cited

U.S. PATENT DOCUMENTS 3,500,708 A 3/1970 Wilson
4,023,449 A * 5/1977 Boyadjieff ..... 81/57.16
4,348,920 A * 9/1982 Boyadjieff ..... 81/57.25
4,843,924 A 7/1989 Hauk
4,972,741 A 11/1990 Sibille
5,060,542 A 10/1991 Hauk
5,081,888 A 1/1992 Schulze-Beckinghausen et al.
5,092,399 A 3/1992 Lang
5,099,725 A 3/1992 Bouligny, Jr. et al.
5,150,642 A 9/1992 Moody et al.
5,174,175 A 12/1992 Bouligny
5,386,746 A 2/1995 Hauk
5,740,702 A * 4/1998 Smith ..... 81/57.33
5,842,390 A 12/1998 Bouligny et al.
5,845,549 A 12/1998 Bouligny
5,868,045 A 2/1999 Hauk
6,142,041 A 11/2000 Buck
6,263,763 B1 7/2001 Feigel, Jr. et al.
6,318,214 B1 11/2001 Buck
6,334,376 B1 1/2002 Torres
6,505,531 B2 1/2003 Stogner
6,634,259 B2 10/2003 Castille
6,682,101 B2 1/2004 Watts
6,722,231 B2 4/2004 Hauk et al.

(Continued)

OTHER PUBLICATIONS

International Search Report and Written Opinion, PCT/US2010/044702; Mailed Oct. 6, 2010.

(Continued)

*Primary Examiner* — Alicia Torres
(74) *Attorney, Agent, or Firm* — Winstead PC

(57) ABSTRACT

An apparatus for making and/or breaking a threaded connection between a first tubular and a second tubular includes a spinner operable to spin the first tubular relative to the second tubular; a zero-side-load ("ZSL") device operable to relieve the transverse force induced on the threaded connection in response to the spinner spinning the first tubular; a torque wrench operable to rotate the first tubular relative to the second tubular; and a back-up wrench operable to grip the second tubular.

28 Claims, 13 Drawing Sheets

(56) References Cited

U.S. PATENT DOCUMENTS

| | | | | |
|---|---|---|---|---|
| 6,752,044 | B2 | 6/2004 | Hawkins, III | |
| 6,776,070 | B1 | 8/2004 | Mason et al. | |
| 6,814,149 | B2 | 11/2004 | Liess et al. | |
| 6,829,968 | B2 | 12/2004 | Hauk et al. | |
| 7,013,759 | B1 | 3/2006 | Childress, II | |
| 7,028,585 | B2 * | 4/2006 | Pietras et al. | 81/57.16 |
| 7,036,396 | B2 | 5/2006 | Moe et al. | |
| 7,062,991 | B1 * | 6/2006 | West et al. | 81/57.16 |
| 7,114,235 | B2 | 10/2006 | Jansch et al. | |
| 7,117,938 | B2 | 10/2006 | Hamilton et al. | |
| 7,121,166 | B2 | 10/2006 | Drzewiecki | |
| 7,188,547 | B1 | 3/2007 | West et al. | |
| 7,191,686 | B1 | 3/2007 | Angelle et al. | |
| 7,313,986 | B2 | 1/2008 | West et al. | |
| 7,413,398 | B2 | 8/2008 | Bangert et al. | |
| 7,455,128 | B2 | 11/2008 | Belik | |
| 7,527,304 | B2 | 5/2009 | Mallis et al. | |
| 2005/0160880 | A1 | 7/2005 | Schulze-Beckinghausen et al. | |

OTHER PUBLICATIONS

Aker, Drill Floor Equipment, circa 2008.
National Oilwell Varco, AR3200—Automated Iron Roughneck, circa 2006.
National Oilwell Varco, AR4500—Automated Iron Roughneck, circa 2006.
National Oilwell Varco, AR5000—Automated Iron Roughneck, circa 2006.
Blohm + Voss Tools, LLC, Floorhand Wrench & Spinner Combination Tool, circa 2009.
Hawk Industries, HAWKJAW Junior, May 13, 2009.
Hawk Industries, HAWKJAW Senior, May 13, 2009.
Patriot Mechanical Handling, Inc., IR1000 & 2000.
National Oilwell Varco, IR3080 Iron Roughneck 55" Arm, circa 2006.
Patriot Mechanical Handling, Inc., IR80 Roughneck.
National Oilwell Varco, Iron Roughneck IR-3080.
National Oilwell Varco, LPT-200 HydraTong, May 23, 2006.
National Oilwell Varco, HITEC A National Oilwell Technology Iron Roughneck, May 13, 2009.
Patriot Mechanical Handling, Inc., Drilling Systems & Equipment Solutions, circa 2007/2008.
Rogers Oil Tool Services, Utility Drill Pipe Tong Model 10, circa 2002.
National Oilwell Varco, ST-80 Iron Roughneck, circa 2005.
National Oilwell Varco, ST-80C Iron Roughneck, circa 2006.
National Oilwell Varco, ST-120 Iron Roughneck, circa 2009.
Hawk Industries, Inc., T-WREX.
Weatherford, TorkWinder Tong, circa 2003.
Access Oil Tools, Pedestal Mounted TwisterSpin Model 108, circa 2004.
Weatherford, TorkWrench 10-100 Iron Roughneck, circa 2009.

* cited by examiner

TUBULAR JOINING APPARATUS

RELATED APPLICATIONS

This application in a non-provisional patent application and claims the benefit of U.S. provisional patent application No. 61/207,891 filed on Aug. 6, 2009.

BACKGROUND

The speed of connecting and disconnecting hundreds of wellbore tubulars makes a great difference in the time required to drill and bring a well onto production. For instance, it is normally necessary to insert and remove the drill string several times during the drilling process wherein numerous threaded connections of the wellbore tubulars (e.g., drilling pipe) have to be made or broken. Due to the high cost of drilling (e.g., rig time), it is desirable to make or break a connection as quickly as possible.

One style of devices for making and breaking wellbore tubulars includes a frame that supports up to three power wrenches and a power spinner each aligned vertically with respect to each other. Examples of such devices are disclosed in U.S. Pat. Nos. 6,722,231; 6,634,259; 5,386,746; and 5,060,542 which are incorporated herein by reference. Additional examples described in U.S. Pat. Nos. 7,455,128; 7,114,235; and 6,776,070 are also incorporated herein by reference. These devices spin one tubular with the power spinner at a relatively high speed but at a relatively low torque while holding another tubular fixed with one of the power wrenches. Traditionally, when making tubulars, the spin process continues until the two threaded tubulars shoulder up, e.g. until a pin shoulder engages the box shoulder. After shouldering up, the power spinner is stopped and two of the power wrenches are used to apply high torque to the connection or joint so that the joint is securely fastened and sealed. The application of high torque rotates the tubulars with respect to each other but at a very low speed of rotation. Once the tubulars are shouldered it is only necessary to rotate a relatively small amount so the low speed of rotation does not slow the process down. Likewise when breaking tubular connections (e.g., pipe joints), two power wrenches apply a high torque to initially break the connection. Then the power spinner spins the top tubular with respect to the lower tubular held by a power wrench until the threaded connection is completely disconnected. In this manner, the connectors can be quickly made or broken to save considerable time and money while drilling a well.

Traditional drill pipe threaded connections facilitated shouldering the pin and the box utilizing the high rotation and low-torque spinners. However, current wellbore tubular threaded connections and wedge thread designs require increasing torque as the pin advances into the box to shoulder the connection. Examples of newer wedge thread connections are described in U.S. Pat. Nos. 7,527,304 and 6,682,101. The result is that the high-speed spinner cannot fully advance the pin into the box requiring additional rotation of the tubular in the torque cycle with the power wrench. For example, a torque cycle for a historically utilized drill pipe may require rotation of the tubular of approximately 20 to 45 degrees, wherein the newer tapered thread connections may require rotation in the torque cycle of about one-hundred and fifty degrees to about two-hundred degrees or more to achieve the proper torque utilizing the prior make and break devices. The increased rotation required in the torque-cycle often requires multiple grip and release operations to achieve the total rotation required. Gripping the tubular, rotating, releasing the grip, repositioning the tong and repeating the process is not only a time-consuming and expensive process but it also can damage the tubular and/or result in an insufficient connection that may result in a string failure and or galling of the threads.

During assembly (e.g., make-up) and disassembly (e.g., break-out) of the threaded connection there is no requirement for lateral (e.g., side, transverse, normal to the tubular axis) forces to be applied to the connection and, in fact such forces can have serious detrimental effects. Frictional forces due to lateral forces cause false torque readings and can cause premature thread galling. The lateral forces can actually bend the tubular. Application of lateral forces during tightening can also cause the connection to tighten off center, which can result in loss of the connection's fluid seal. The prior art tubular joining devices impose linear, lateral (e.g., side-load) forces on the threaded connection.

There is a continuing desire to provide a tubular make and break device that promotes tubular connection efficiency. It is a desire to promote higher torque spinning cycles. It is a further desire to minimize side loading on the threaded connection during the spinning cycle and/or the torque cycle. It is a still further desire to minimize box distortion while spinning up the tubular connection. It is a further desire to provide continuous rotation during the torque-cycle.

SUMMARY

An apparatus for making and/or breaking a threaded connection between a first tubular and a second tubular according to one or more aspects of the present disclosure may include a spinner operable to spin the first tubular relative to the second tubular; a zero-side-load ("ZSL") device operable to relieve the transverse force induced on the threaded connection in response to the spinner spinning the first tubular; a torque wrench operable to rotate the first tubular relative to the second tubular; and a back-up wrench operable to grip the second tubular.

Another example of an apparatus for making and/or breaking a threaded connection between a first and a second tubular according to one or more aspects of the present disclosure may include a spinner operable to spin the first tubular relative to the second tubular; a torque wrench; a back-up wrench; and a torsion device connected to the torque wrench and the back-up wrench, wherein the torsion device is operable to relieve a transverse force induced by rotating the torque wrench and first tubular relative to the back-up wrench.

An example of a method for making-up a threaded connection between a first tubular and a second tubular according to one or more aspects of the present disclosure may comprise providing a tubular joining device comprising a spinner, a torque wrench and a back-up wrench; gripping the second tubular with the back-up tong; spinning the first tubular via the spinner to advance the pin relative to the box; relieving a transverse force induced on the threaded connection in response to spinning the first tubular; gripping the first tubular with the torque wrench; and rotating the first tubular with the torque wrench to complete the threaded connection.

The foregoing has outlined some of the features and technical advantages of the present disclosure in order that the detailed description that follows may be better understood. Additional features and advantages will be described hereinafter which form the subject of the claims of the invention.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
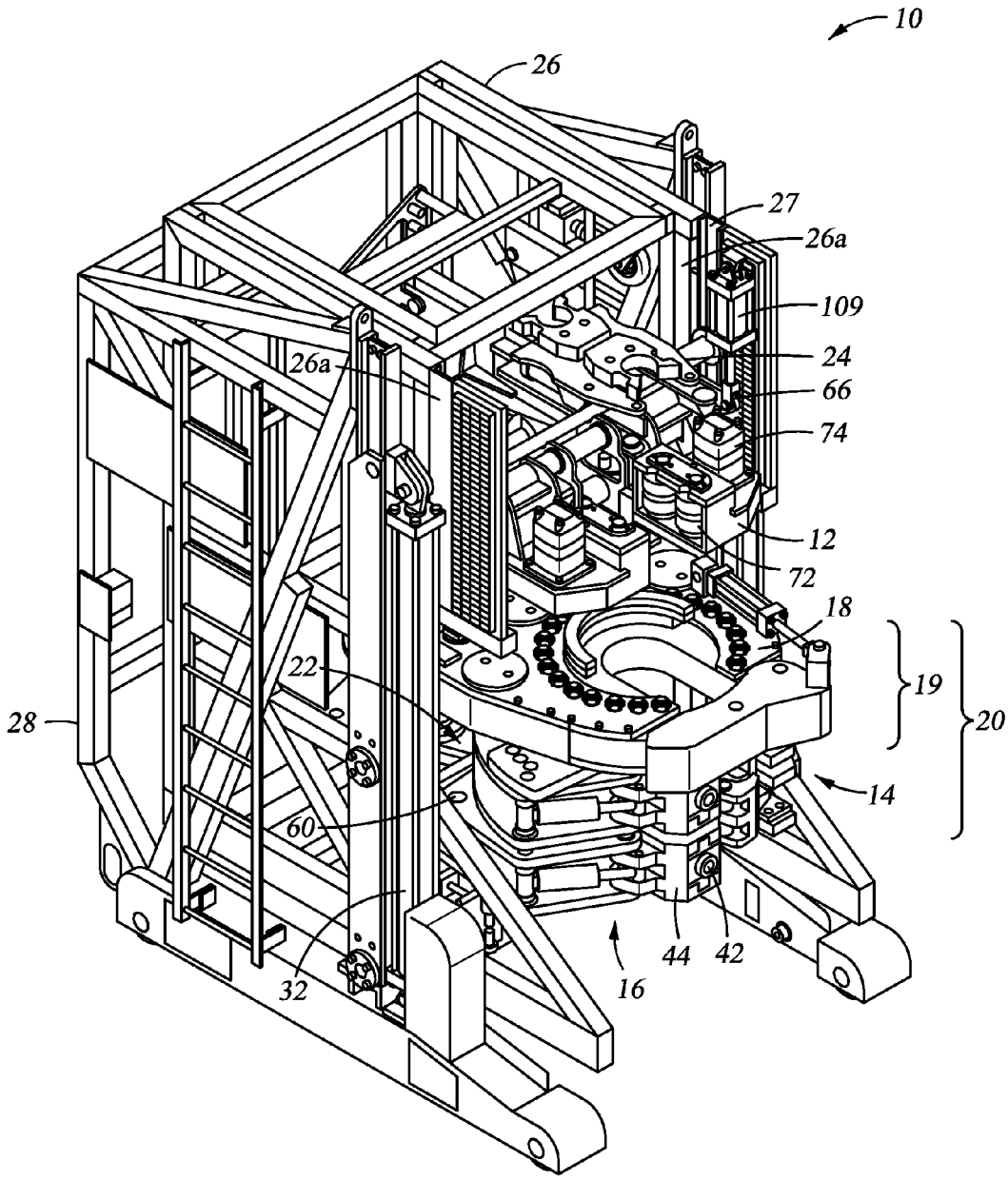
FIG. 1 is a perspective view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
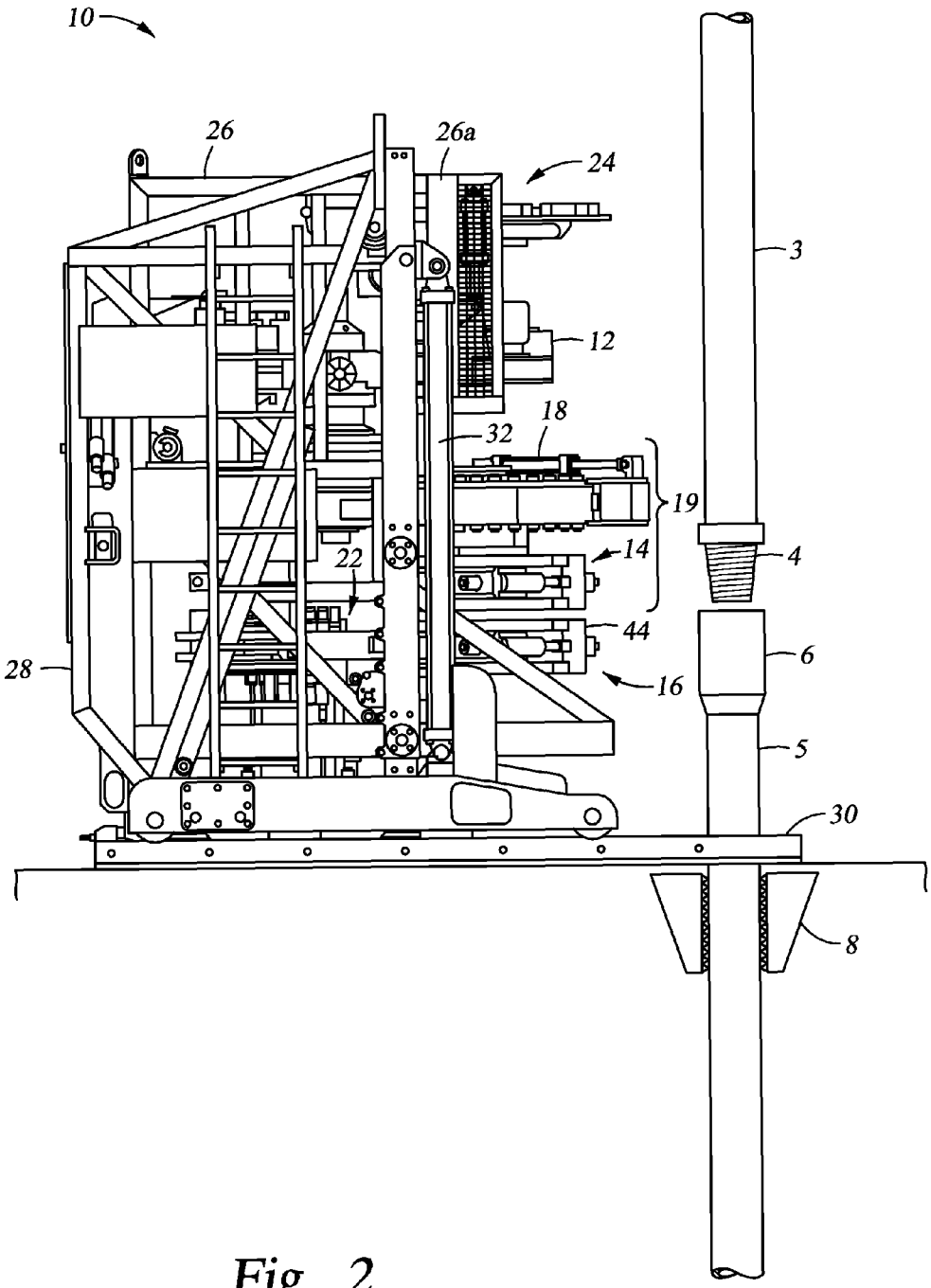
FIG. 2 is an elevation view of an apparatus according to one or more aspects of the present disclosure.

FIG. 1 is a schematic view of an apparatus 10 for making and/or breaking tubular connections (e.g., pipe joint connections) according to one or more aspects of the present disclosure. FIG. 2 is a schematic view of apparatus 10 positioned at the surface of a well for making and/or breaking threaded connections between a first tubular 3 and a second tubular 5. Tubular 3 is depicted as the add-on tubular or upper tubular relative to the other tubular and the well and second tubular 5 is depicted suspended in the well and being held by spider 8. Each tubular may include a single tubular joint or multiple tubular sections that form a stand and/or string. Tubulars 3 and 5 are described for purposes of example as drill pipe, however, apparatus 10 may be utilized with other wellbore tubulars including without limitation, tubing, casing, and liners. The threaded connection comprises a threaded pin 4 adapted to mate with box 6 depicted with second tubular 5.

Apparatus 10, depicted in FIGS. 1 and 2, includes a spinner 12, a wrench 14 (e.g., torque wrench, power tong), and a back-up wrench 16. Torque wrench 14 and back-up wrench 16 are also referred to herein as tong assembly 20 herein. Depicted in FIG. 1, torque wrench 14 is part of a power tong 19 which includes rotary drive 18 and torque wrench 14 (e.g., jaws). In the depicted embodiment, torque wrench 14 is provided in connection with, but exterior of, the rotary drive 18. As described further below, torque wrench 14 may be incorporated into rotary drive portion 18. In some embodiments, torque wrench 14 may be rotated continuously. In some embodiments, torque wrench 14 may rotate the first tubular greater than about 180 degrees relative to the second tubular without releasing the grip of torque wrench 14. In some embodiments, torque wrench 14 may rotate the first tubular at least about 270 degrees or greater relative to the second tubular without releasing the grip of torque wrench 14. In some embodiments, torque wrench 14 may rotate the first tubular at least about 360 degrees relative to the second tubular without releasing the grip of torque wrench 14. Tong assembly 20 may comprise a torsional-load transfer device, further described below, to relieve (e.g., prevent, reduce, minimize, eliminate) the side-load forces applied during make-up of the pipe joint connection at pin 4 and box 6. The torsional-load transfer device, also referred to as a zero-side load ("ZSL") device, is generally denoted by the numeral 22.

Spinner 12 according to one or more aspects of the present disclosure may also include a zero-side-load device which is not visible in FIGS. 1 and 2. A ZSL device 86 according to one or more aspects of the present disclosure is described below with reference to FIGS. 12-14. Apparatus 10 may comprise a stabber 24 to aide in positioning of tubular 3.

Apparatus 10 is adapted for movement to and from the well (e.g., wellbore, borehole). For example, in FIGS. 1 and 2, spinner 12 and tong assembly 20 are connected within a cassette 26 (e.g., frame) which is disposed and connected with a carriage 28 (e.g., frame). In this example, carriage 28 and apparatus 10 are transported to and from the well and tubulars 3, 5 on rails 30. In FIGS. 1 and 2, actuators 32 are provided to move apparatus 10 and cassette 26 vertically relative to carriage 28 and thus the well. Other devices and structures may be utilized to position apparatus 10 as required.

Figure 3:
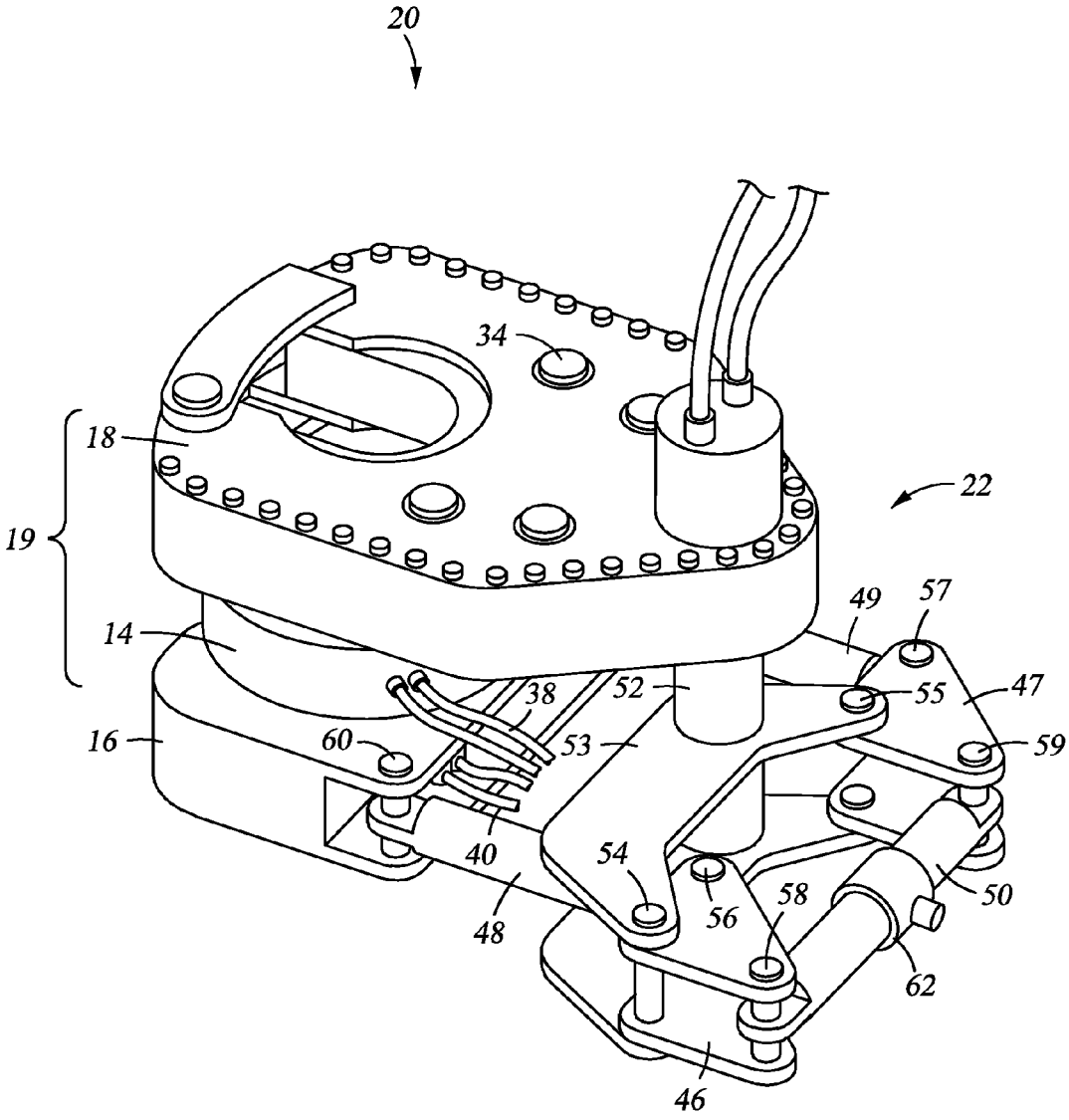
FIG. 3 is a schematic perspective view of a tong assembly according to one or more aspects of the present disclosure.
Figure 4:
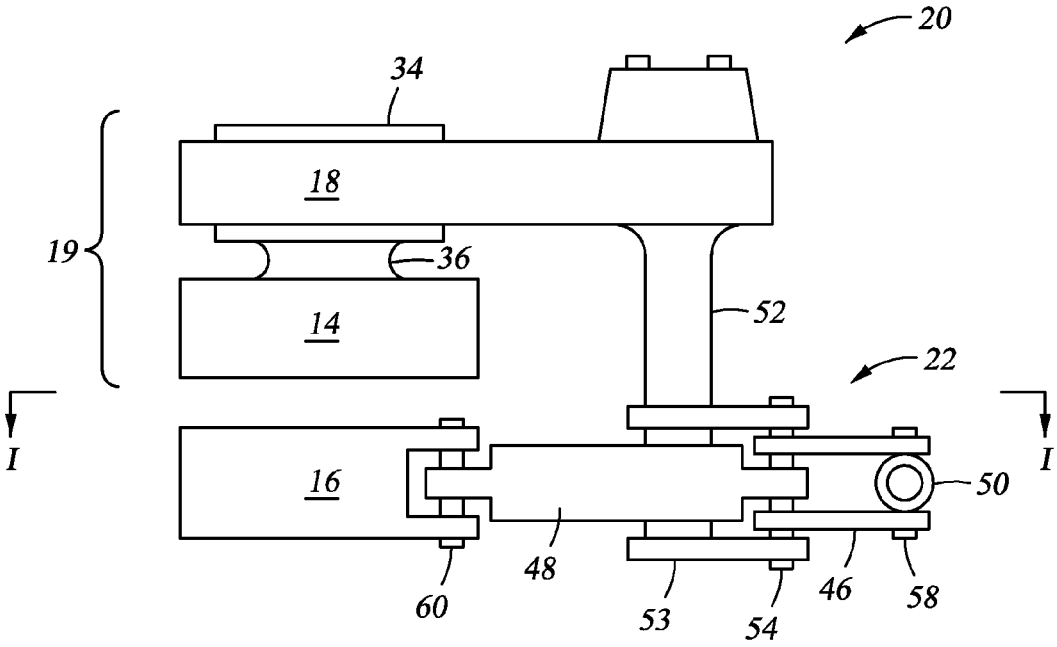
FIG. 4 is a schematic elevation view of the tong assembly of FIG. 3 according to one or more aspects of the present disclosure.
Figure 5:
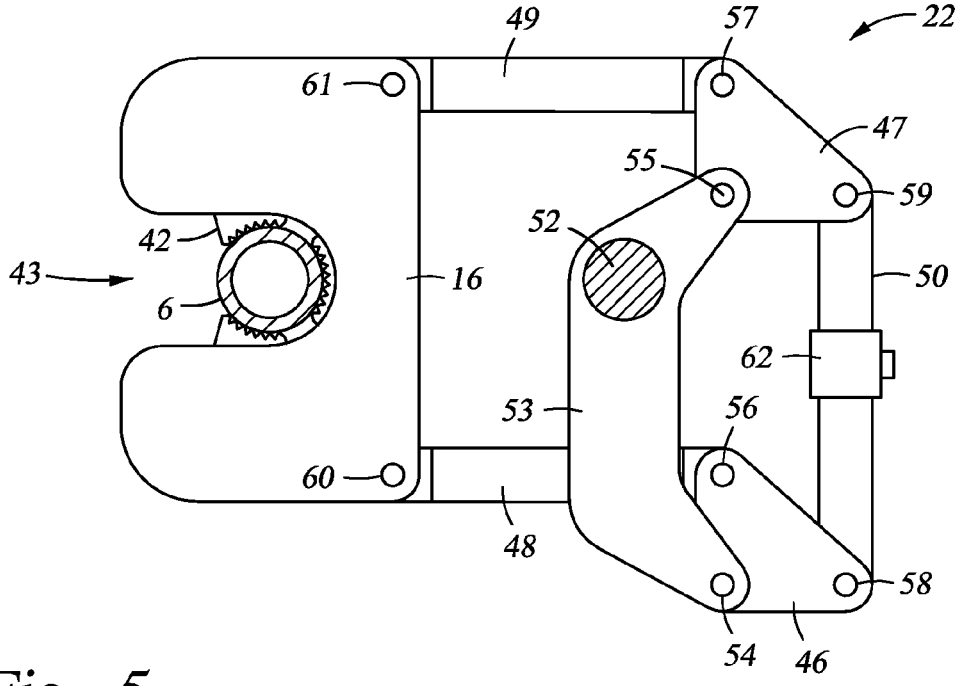
FIG. 5 is a schematic view the tong assembly of FIGS. 3 and 4 along the line I-I of FIG. 4 according to one or more aspects of the present disclosure.

FIG. 3 is a perspective view of a tong assembly 20 according to one or more aspects of the present disclosure. FIG. 4 is a side view of tong assembly 20 depicted in FIG. 3. FIG. 5 is a view of tong assembly 20 along the line I-I of FIG. 4. In the depicted example, tong assembly 20 includes torque wrench 14 (including rotary drive 18) and back-up wrench 16. Torque wrench 14 and rotary drive 18 are operationally connected as a power tong 19. In this embodiment, torque wrench 14 carries the jaws or gripping member (not shown) for grasping the tubular (e.g., tubular 3 of FIG. 2). An adapter 36 (FIG. 4) transfers the torque from rotary gears 34 of drive 18 to torque wrench 14. An example of gripping members, and of a torque wrench 14, is disclosed in U.S. Pat. No. 5,845,549, which is incorporated herein by reference.

Torque wrench 14 may be incorporated into drive portion 18 of the tong. An example of a wrench incorporated into the rotary gears to provide continuous rotation is disclosed in U.S. Pat. No. 5,150,642, which is incorporated herein by reference. In the depicted embodiments it is desired to provide substantially continuous rotation of the add-on tubular while applying torque. Depicted power tong 19 may be operable to provide continuous rotation of torque wrench 14 (e.g., 360 degrees). As depicted in FIGS. 3-5, torque wrench 14 is limited to about 270 degrees of continuous rotation without releasing the grip of torque wrench 14 due to the hydraulic connections. For example, hydraulic hoses 38 to torque wrench 14 and hydraulic hoses 40 to back-up wrench 16 limit the continuous rotation of the gripping components of torque wrench 14 (FIG. 3). True continuous rotation of torque wrench 14 may be provided by various hydraulic hose routing and connection schemes and/or via statically powered gripping torque wrench 14. For example, utilizing an accumulator to maintain hydraulic pressure at torque wrench 14 may be utilized. In another example, a fluid grip type system such as disclosed in U.S. Pat. No. 5,174,175, incorporated by reference herein, may be utilized.

Torque wrench 14 and back-up wrench 16 may utilize the same type or different tubular gripping mechanisms. Referring in particular to FIG. 5, a gripping mechanism with reference to back-up wrench 16 is described. Back-up wrench 16 is depicted having three gripping jaws 42 engaging the outer circumference of lower tubular 5 (FIG. 2). In particular, jaws 42 are gripping box 6 of tubular 5. In some embodiments it is desired to utilize three gripping members 42, although more or fewer may be used to distribute the gripping force and limit or eliminate the ovalization of the box connection. For example, some embodiments may utilize two opposed gripping members. The arrangement of gripping jaws 42 are schematically shown for purposes of description and may be arranged in various configurations and manners. In the depicted example of FIGS. 3-5, two of the gripping members 42 are referred to as dead members and the third gripping member 42 is a live member. The dead gripping members are non-powered members and the live gripping member is powered and moveable. Although not illustrated in the schematic views of FIGS. 3-5, torque wrench 14 and/or back-up wrench 16 may include doors 44 (FIGS. 1 and 2) for closing the entrance to the opening 43 of the respective wrenches.

In FIGS. 1 and 2, wrenches 14 and 16 include similar types of pipe gripping mechanisms. In this embodiment, wrenches 14, 16 each include a door 44 for closing access to the wrenches. In these embodiments, the live gripping member is located in door 44 and is hydraulically actuated. For example, three gripping members may be provided and spaced approximately 120 degrees apart when door 44 is closed. In one example, the two-dead gripping members 42 would be positioned at the back of opening 43 (FIG. 5) relative to door 44 (FIGS. 1 and 2). The third gripping member is a live member and located in door 44. When door 44 is hydraulically closed, the third live gripping member is rotated onto the tubular at about 120 degrees to the two dead gripping member.

Back-up wrench 16 may grip the box connection during the spinning cycle and/or during the torque cycle. In some operations, back-up wrench 16 may be utilized to grip tubular 5 so as to stabilize and position spinner 12 centered over tubular 5 (e.g., the wellbore) and/or to restrain the second tubular from rotating. When back-up wrench 16 is gripping the box connection during the spinning cycle it may be desired for back-up wrench 16 to maintain a relatively low clamping force on box 6 to avoid distorting the box (e.g., ovalization). During the torque (e.g., wrenching) cycle it is typically desired for back-up wrench 16 to maintain a significantly greater clamping force on box 6 then during the spinning cycle. In some embodiments, back-up wrench 16 is adapted for applying a first gripping pressure to box 6 during the spinning cycle and for applying a second gripping pressure to box 6 during the torque cycle. An example of a dual gripping force wrench is disclosed in U.S. Pat. No. 6,634,259 which is incorporated herein.

During assembly (e.g., make-up) and disassembly (e.g., break-out) of a threaded connection there is no requirement for lateral (e.g., side, transverse, normal to the tubular axis) forces to be applied to the connection and, in fact, such forces can have serious detrimental effects. Frictional forces due to lateral forces cause false torque readings and can cause premature thread galling. The lateral forces can actually bend the tubular. Application of lateral forces during tightening can also cause the connection to tighten off center, which can result in loss of the connection's fluid seal. The undesirable lateral forces (e.g., side-load) are described further with references to FIGS. 6A-6C, 7A-7C and 8 below and in U.S. Pat. Nos. 4,972,741 and 5,099,725, which are incorporated herein by reference.

When a lead wrench is operated, a rotary element contained within the wrench grasps a first threaded tubular. A motor, usually hydraulic, associated with the lead wrench generates a "driving torque" which is applied to the rotary element to rotate it, and the first threaded member therein, in the desired direction. By operation of Newton's third law of physics (that is, in essence, "for every force there exists an equal and opposite force"), creation of the "driving torque" (which is applied to the threaded member) results in a "reaction torque", which is applied to the lead wrench in the opposite direction. This reaction torque must be counteracted, to secure the lead wrench body from spinning about the tubular rather than driving the tubular itself.

It is common practice in tubular joining devices to secure the lead wrench against rotation about the tubular by use of a snubbing line or a "reaction bracket" which rigidly cooperates with the back-up wrench, or multiple members which rigidly (or resiliently) cooperate with the back-up wrench. All of these conventional reaction devices produce linear, laterally directed and unpaired force vectors on the lead wrench. The lead wrench tends to move laterally in response to the linear force vectors, which said lateral movement is resisted by the tubular.

With reference to back-up wrenches, a similar phenomenon occurs. Devices commonly used to secure back-up wrenches from rotating with the tubular result in a lateral force being applied to the second threaded member. The lateral force vector applied to the second threaded member is equal in magnitude, but opposite in direction to the lateral force induced by the lead wrench above. A combination of the lateral force imposed on the upper tubular by the lead wrench and on the lower tubular by the back-up wrench produces a bending moment across the tubular joint being tightened or loosened.

Figure 6C:
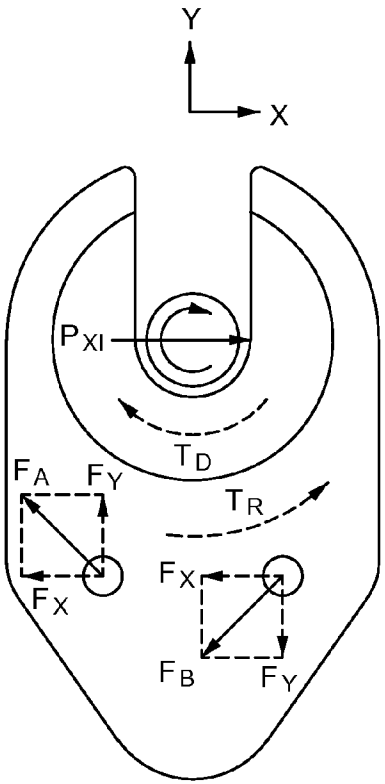
Fig. 6C (PRIOR ART)
FIGS. 6A-6C are schematic top views of prior art lead tongs illustrating force vectors during make-up of a threaded tubular connection.
Figure 6B:
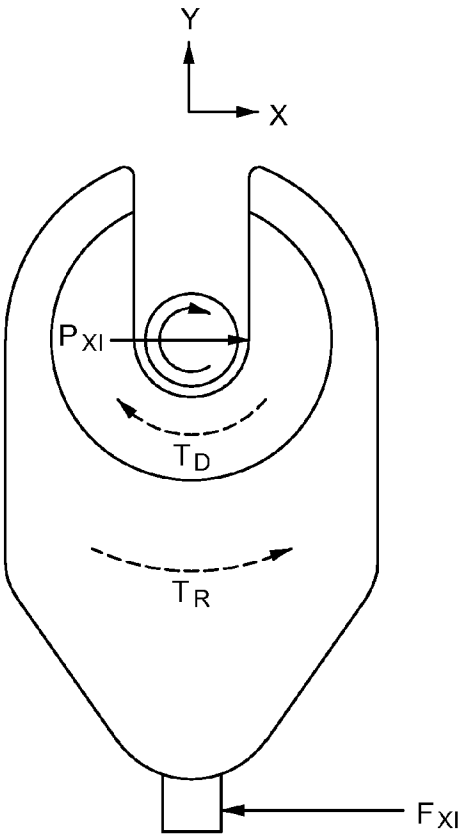
Fig. 6B (PRIOR ART)
Figure 6A:
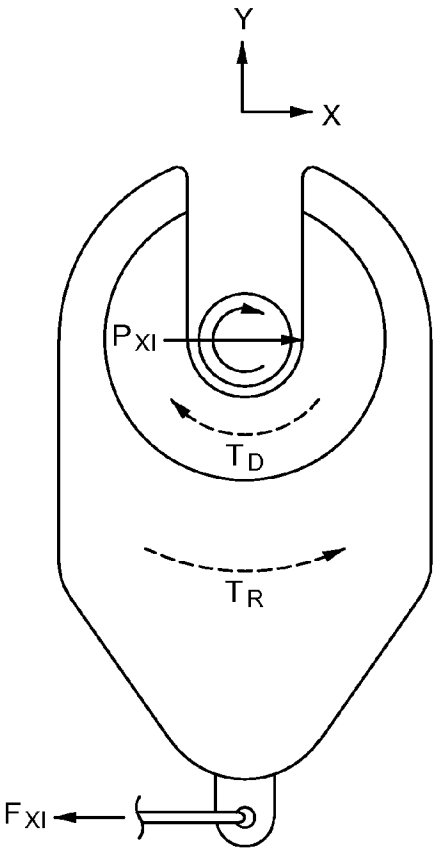
Fig. 6A (PRIOR ART)

With reference to FIG. 6A, showing prior art, it is seen that when a lead wrench is operated it produces a driving torque, $T_D$, which acts on a rotary element which is grippingly engaged to a first threaded member (e.g., the upper tubular). In response to the driving torque, $T_D$, a reaction torque, $T_R$, is imposed on the wrench in the direction opposite to that of tubular rotation. The lead wrench must be secured against rotation about the tubular axis, in response to $T_R$, otherwise the wrench would simply rotate about the tubular rather than rotating the tubular itself.

With reference to FIGS. 6A, 6B and 6C, showing prior art, it is seen that conventional devices for securing a lead wrench against rotation in response to $T_R$, whether by a snubbing line (FIG. 6A), reaction bracket (FIG. 6B) or multiple rigid interconnects to the back-up wrench (FIG. 6C) all involve lateral, linear forces, $F_X$, being imposed on the wrench. In response to $F_X$, the wrench tends to move laterally. The lateral movement of the wrench causes deflection of the tubular, which gives rise to $P_X$, which then counteracts $F_X$. Therefore, while both rotational and linear equilibrium of the wrench is achieved by the reaction device(s), it is at the expense of lateral deflection of the tubular. As driving torque, $T_D$, increases; the reaction torque, $T_R$, also increases; as does the force required to secure the wrench against rotation, $F_X$; and as does the force, $P_X$, which is developed by the tubular in response to lateral deflection.

Figure 7A:
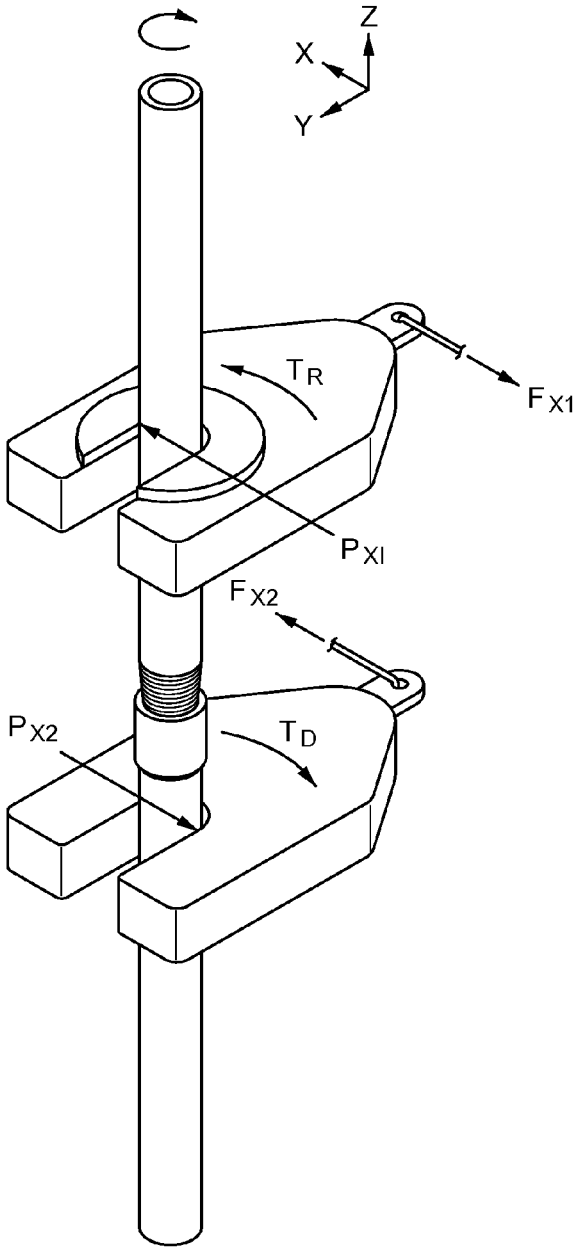
Fig. 7A (PRIOR ART)
FIGS. 7A-7C are schematic perspective views of prior art tong assemblies illustrating transverse loads induced on the threaded connection.
Figure 7B:
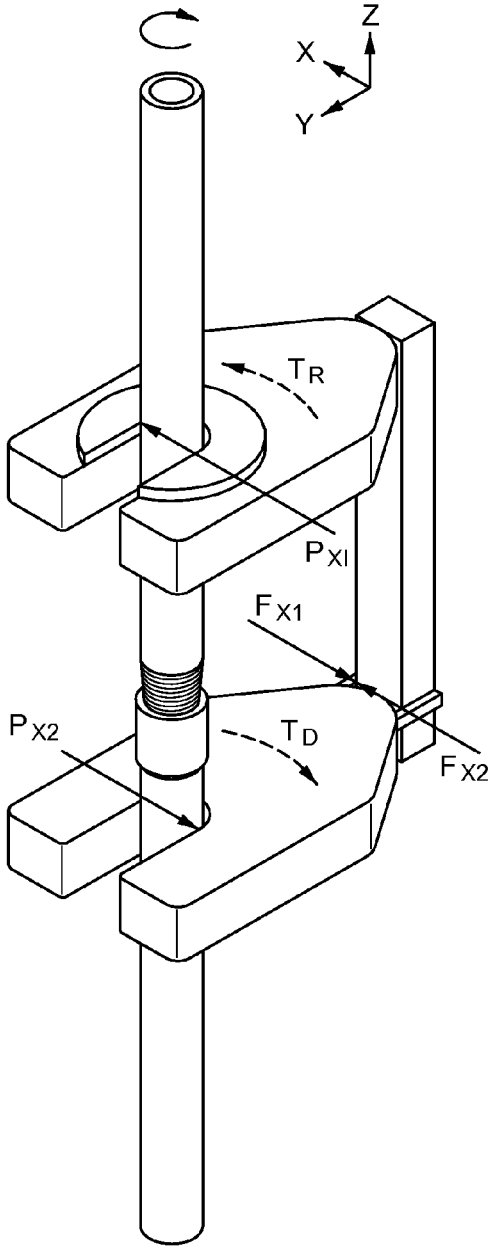
Fig. 7B (PRIOR ART)
Figure 7C:
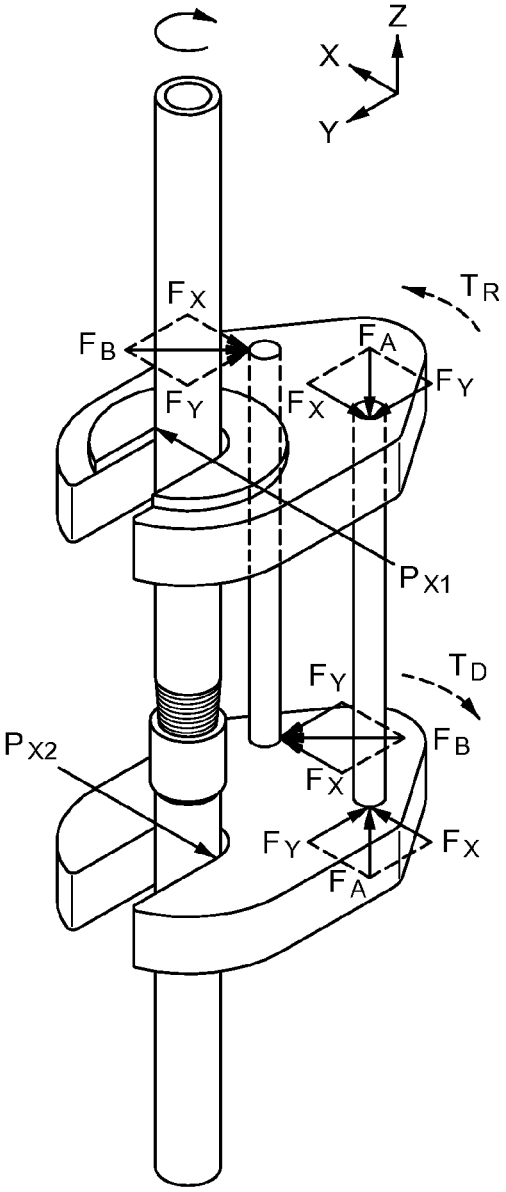
Fig. 7C (PRIOR ART)
Figure 8:
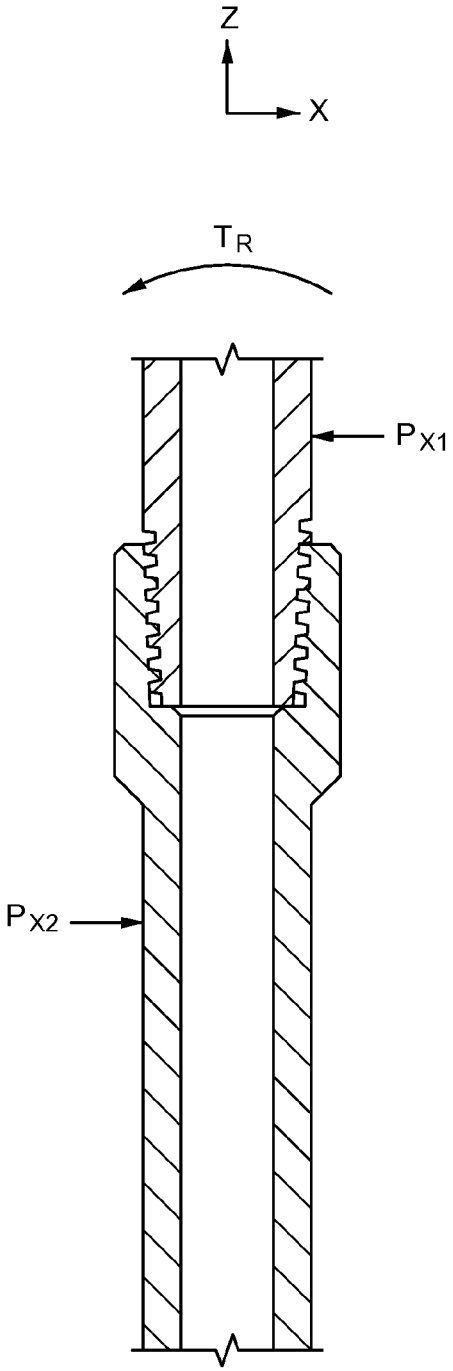
FIG. 8 is a schematic elevation view illustrating transverse loads on a tubular connection.

With reference to FIGS. 7A, 7B and 7C, showing prior art, it is seen that a similar (but opposite direction) reaction occurs at the level of the back-up wrench. The driving torque of the lead wrench, $T_D$, is transferred through the threaded members to the back-up wrench which is grippingly engaged to the second threaded member (e.g., the lower tubular). The back-up wrench therefore tends to rotate with the second threaded member, instead of securing the second member against rotation, unless the back-up wrench is restrained against rotary movement. One conventional device to secure a back-up wrench against rotation involves use of a rearwardly attached snubbing line (FIG. 6A). Other prior art devices to secure a back-up wrench against rotation involves use of a reaction bar (FIG. 7B) or use of multiple rigid interconnects (FIG. 7C). These prior art devices impose lateral (e.g., side-load) forces, $F_X$, on the back-up wrench, which causes lateral deflection of the tubular, which gives rise to $P_X$. While rotational and linear equilibrium of the back-up wrench is achieved, again, it is achieved at the expense of lateral deflection of the tubular.

The application of lateral forces on a tubular joint during tightening or loosening can have serious undesirable effects. Extra, and uneven, friction forces (see FIG. 8) caused by such side-loading may result in poor fluid sealing at the threaded connection, inadequate tightening at the threaded connection, and/or a mechanical failure at the threaded connection.

Apparatus 10 depicted in FIGS. 1 and 2 comprises a device, referred to generally torsion control device 22, or as a zero-side load ("ZSL") device, connecting torque wrench 14 to back-up wrench 16 in such a manner that no single, unpaired force, but rather only "couples" (paired forces of equal magnitude, but opposite direction) are created by torsion control device 22. A novel torsion control device 22 according to one or more aspects of the present disclosure is now described with reference to FIGS. 3-5. Depicted torsion control device 22 may be referred to as a bell crank type of device. Torsion control device 22 may comprise a pair of bell cranks 46, 47; spaced apart lateral struts 48, 49; a cross (e.g., cell) strut 50; a torque member (e.g., post) 52; and tong span 53.

Each bell crank 46, 47 may comprise three pivot points at which members are pivotedly connected. The pivot connections (e.g., pivot points) form a ninety-degree triangle in the depicted embodiment. The pivot connections are identified respectively as tong pivot connections 54, 55; lateral pivot connections 56, 57 and cross pivot connections 58, 59. In FIGS. 3-5, the pivot connections are depicted as pins. As is known in the art, other pivot connections may be provided including bearing and non-bearing connections.

Lateral struts 48, 49 are equal in length and maintained parallel to one another. Lateral strut 48, identified as the left side of FIGS. 3-5, is pivotedly connected to bell crank 46 at lateral pivot 56 and to back-up wrench 16 at wrench pivot 60. Similarly, right lateral strut 49 is pivotedly connected to bell crank 47 at lateral pivot 57 and to back-up wrench 16 at pivot point 61. The connection of lateral struts 48, 49 between back-up wrench 16 at pivots 60, 61 and lateral pivots 56, 57 forms a parallelogram. Note that in some embodiments, one lateral strut 48, 49 may be connected at a wrench pivot to torque wrench 14 and the other connected at a wrench pivot to back-up wrench 16.

Cross strut 50 (e.g., load cell strut) is connected to bell crank 46 at pivot 58 connection and to bell crank 47 at pivot 59 connection. Torque post 52 extends from torque wrench 14 via drive 18 of the depicted power tong 19. Bell cranks 46, 47 are connected to torque wrench 14. For example, bell cranks 46, 47 are connected at pivot connections 54, 55 located at opposing ends of a member, identified as tong span 53 that extends from torque post 52.

When making-up a connection, back-up wrench 16 is urged to rotate clockwise with the tubular, said rotation is resisted by parallel lateral struts 48, 49. Left lateral strut 48 is in tension and right lateral strut 49 is in compression. Lateral struts 48, 49 are spaced equal distances for the center of the rotated tubular and the forces in the lateral struts are equal and opposite one another. The longitudinal forces of struts 48, 49 cancel out and the moments between the tubular's torque and struts 48, 49 cancel out; thus, the loads are completely balanced without generating a transverse load to the treaded connection.

The moments and force are resolved on back-up wrench 16 with lateral struts 48, 49. The forces of lateral struts 48, 49 are resolved into back-up wrench 16. When strut 48 is in tension, the longitudinal force is transferred to bell crank 46. The longitudinal forces on lateral strut 48 and the transverse load from cross strut 50 are resolved into tong pivot 54. Recall that pivots 54, 56 and 58 form a ninety-degree triangle, thus, tong pivot 54 is subject to the resultant of both longitudinal and transverse forces. The tension force in strut 48 tends to rotate bell crank 46 counterclockwise about tong pivot 54 and cross strut 50 applies an opposing moment to bell crank 46, which in turn remains stationary.

Meanwhile, right lateral strut 49 is in compression and its longitudinal force is transferred into right bell crank 47. The compression forces in strut 49 tend to rotate bell crank 47 clockwise about tong pivot 55. Cross strut 50 applies an opposing moment to bell crank 47, which in turn remains stationary.

Cross strut 50 reacts in compression against bell cranks 46, 47. Since the opposing ends of cross strut 50 are being loaded by bell cranks 46, 47 inwardly, cross strut 50 is statically balanced. A load cell 62, electric or hydraulic, may be adapted at cross strut 50 to identify the make-up torque applied. As noted, torsion control device 22 relieves the transverse load at the threaded connection and may provide for measuring the true torque (e.g., pure torque) applied to making-up the connection at cross strut 50.

Bell cranks 46, 47 are statically balanced by the strut 48, 49 and cross strut 50 reaction moments. Tong pivots 54, 55 experience the longitudinal loads form the lateral struts 48, 49 and the transverse loads from cross strut 50. When cross strut 50 is in compression, tong pivots 54, 55 apply equal and opposite tension along in span 53. Torque post 52 is fixedly connected (e.g., welded) to tong span 53. The internal tension forces in span 53 are not transmitted into torque post 52. The longitudinal loads from tong pivots 54, 55 are not transferred to torque post 52 as the longitudinal loads from lateral struts 48, 49 are canceled out.

A moment couple is transferred from lateral struts 48, 49 into torque post 52. The difference between the transverse distance from post 52 to left tong pivot 54 and the transverse distance between post 52 and right tong pivot 55 is inconsequential. A moment may be resolved with an opposing moment applied anywhere on the body. The lateral struts 48, 49 transmit a pure torque through torque post 52 into tong 19. Consequently, torque wrench 14 of tong 19 will apply zero side-loads (e.g., transverse, lateral force) to the connection, and the output torque is resolved with equal and opposite torque through post 52. Note that pure, or true, torque is the torque actually being applied to the connection. Traditional torque measurements may include the forces lost in the reaction torque and the transverse force.

Torsion control device 22 and tong assembly 20 is briefly described with reference to breaking a threaded tubular connection. Torsion control device 22 generally experiences a reversal of loading when breaking connections. Torque wrench 14 will typically apply a counterclockwise torque. Lateral strut 48 is put into compression and tries to rotate bell crank 46 clockwise. Lateral strut 49 is in compression and tries to rotate bell crank 47 counterclockwise. The result is that bell cranks 46, 47 place cross strut 50 in tension.

Figure 9:
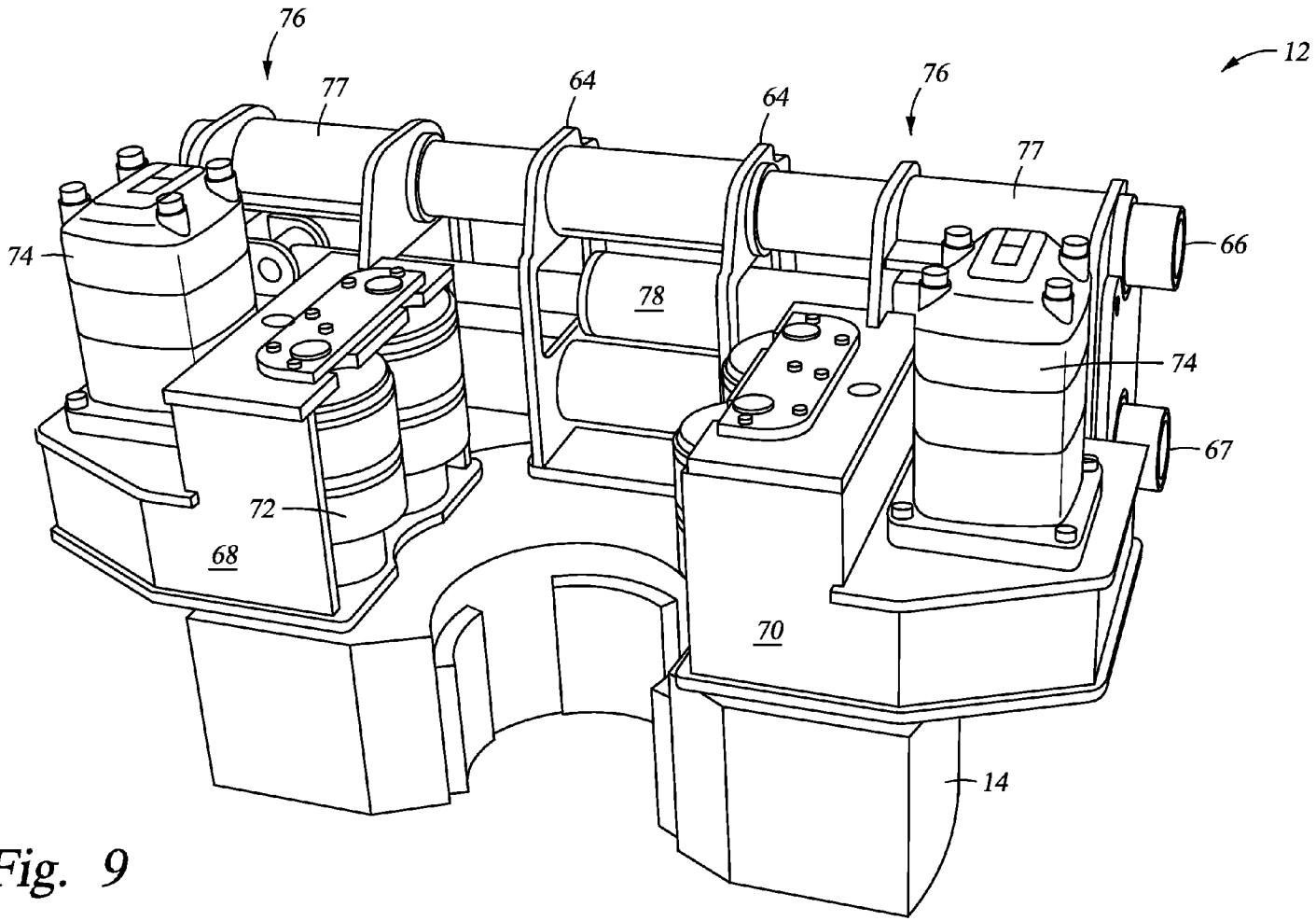
FIG. 9 is a schematic perspective view from the front of a spinner without a zero-side-load device according to one or more aspects of the present disclosure.
Figure 10:
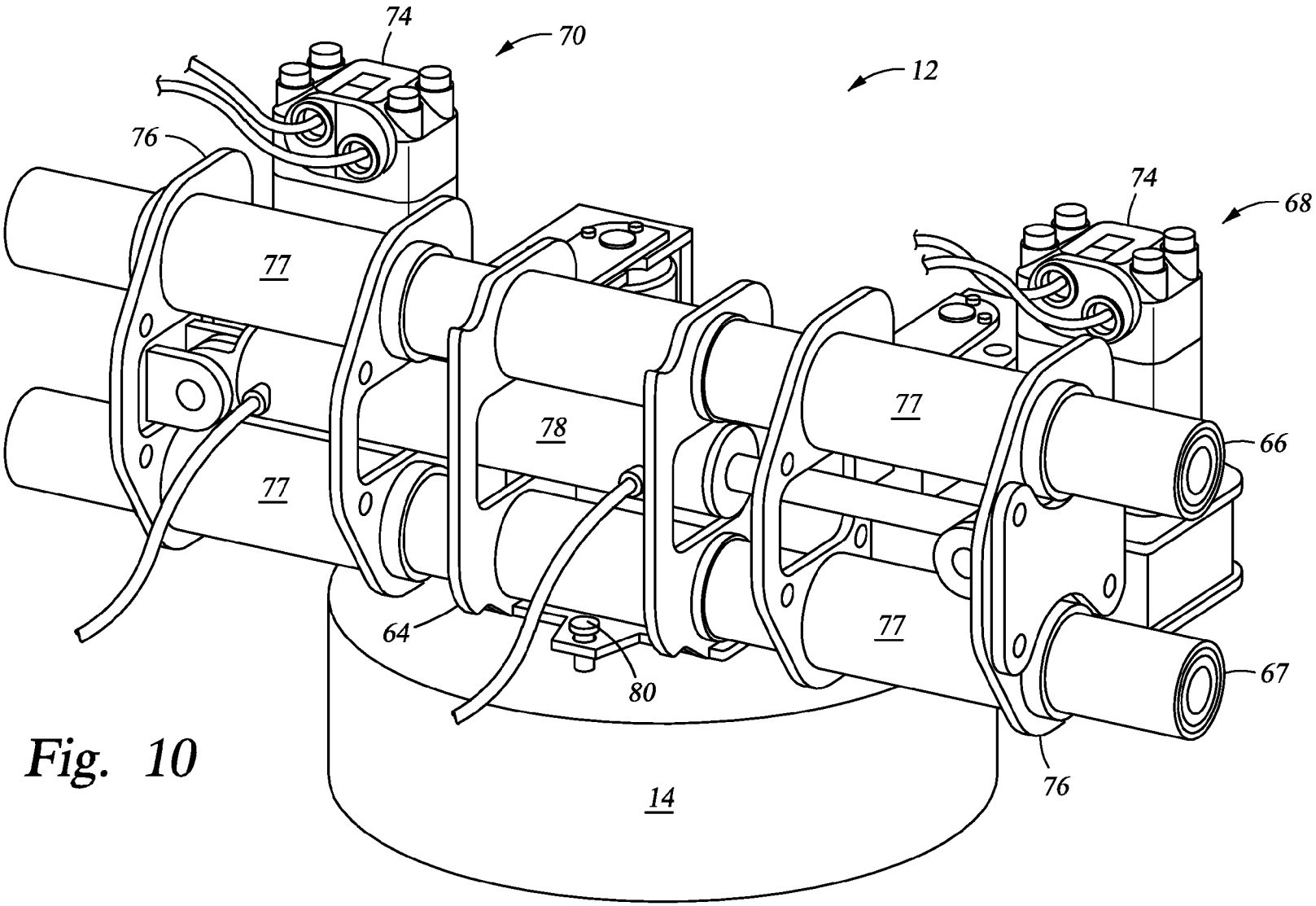
FIG. 10 is a schematic perspective view from the back of a spinner without a zero-side-load device according to one or more aspects of the present disclosure.

FIGS. 9 and 10 are perspective views of an example of a spinner 12, in isolation, that does not include a torsional-transfer device (e.g., zero-side-load). Apparatus 10 of FIGS. 1 and 2 may utilize a convention spinner according to one or more aspects of the present disclosure. The depicted example is of a slider-style spinner utilizing rollers 72. Other types of spinners and spinner drives may be utilized including without limitation chain spinners. Elements of spinner 12 may be acquired from Blohm & Voss Oil Tools, LLC. Spinner 12 includes a center frame 64 which may be connected to torque wrench 14 (shown as a unitary power wrench in this example). Slide rods 66 and 67 are connected in a parallel fashion by frame 64. A first and a second roller assembly 68, 70 are slidably connected on opposite sides of frame 64 to slide rods 66, 67. Each roller assembly 68, 70 include rollers 72 and a motor 74 (e.g., hydraulic motor). Roller assemblies 68, 70 each comprise a frame 76. Frame 76 may include sleeves (e.g., tubes) 77 disposed on rods 66, 67 to facilitate movement and aid in providing a clamping force on the tubular as depicted for example in FIG. 11. An actuator 78 (e.g., hydraulic cylinder) may be connected between the first and second roller assemblies 68, 70 to move the assemblies laterally relative to one another along slide rods 66, 67. In the conventional spinners, such as depicted in FIGS. 9 and 10, the torque reaction is often accomplished with a semi-rigid mounting of frame 64 through reaction pin 80 to torque wrench 14, for example. In the embodiments depicted in FIGS. 1, 2 and 12-14, in particular, spinner 12 is not connected to torque wrench 14 or back-up wrench 16 and the torque from the spinner is transmitted into the cassette and not into either of torque wrench 14 or back-up wrench 16.

Figure 11:
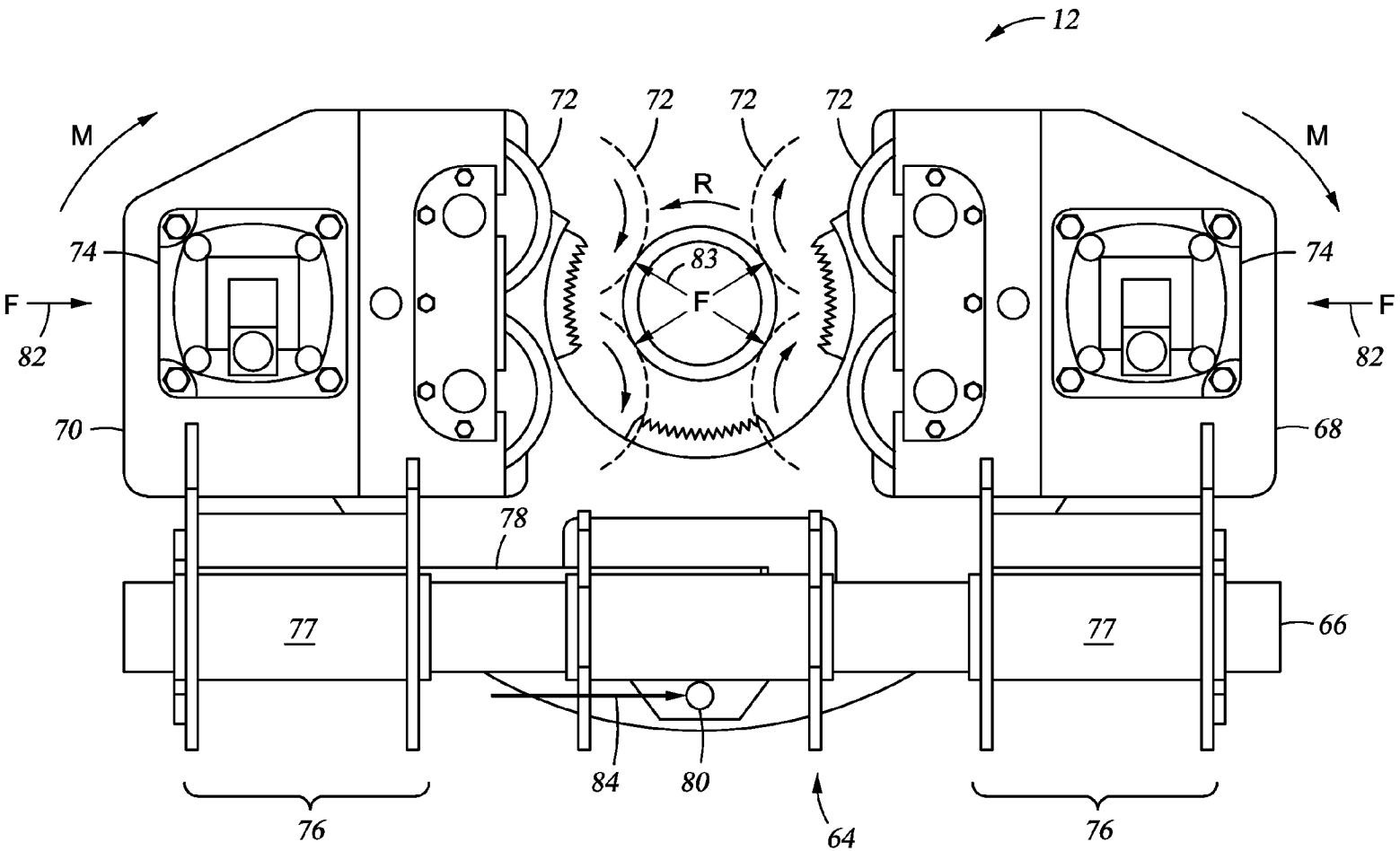
FIG. 11 is a schematic plan view of a spinner without a zero-side-load device according to one or more aspects of the present disclosure.

Refer to FIG. 11 wherein a top view of a conventional spinner 12, without a ZSL device, is illustrated. Actuator 78 may be operated to move roller assemblies 68, 70 laterally into contact with tubular 3 as shown by the dashed line. Motors 74 are energized rotating rollers 72. The friction between tubular 3 and rollers 72 torques tubular 3 clockwise to make a connection and counter-clockwise (depicted) to break a connection. Rollers 72 continue to rotate until the tubulars shoulder up and then stalls. Rollers 72 will continue to spin after the clamping force of rollers 72 is overcome by the friction forces unless the motors stall.

Torque reaction in a conventional spinner installation is now described when breaking a threaded connection with reference to FIG. 11 in particular. The moments are shown by arrows designated "M," the rotations by the arrows designated "R" and the forces are shown by the arrows designated "F". The clamping force 82 is resisted by the horizontal components of force vectors ("F") 83 on rollers 72. The torque to spin tubular 3 is applied as rotation "R" on rollers 72. Due to fraction of rollers 72 on tubular 3, each roller assembly 68, 70 is subject to a moment "M". In this embodiment, reaction pin 80 may be the only restraint preventing spinner 12 from rotating about tubular 3. The location of reaction member 80 relative to tubular 3 means that the torque will be reacted as a side load 84, shown by an arrow, on reaction member 80. In order to balance the transverse forces the normal loads on rollers 72 must become unbalanced as illustrated by force vectors 83.

Figure 12:
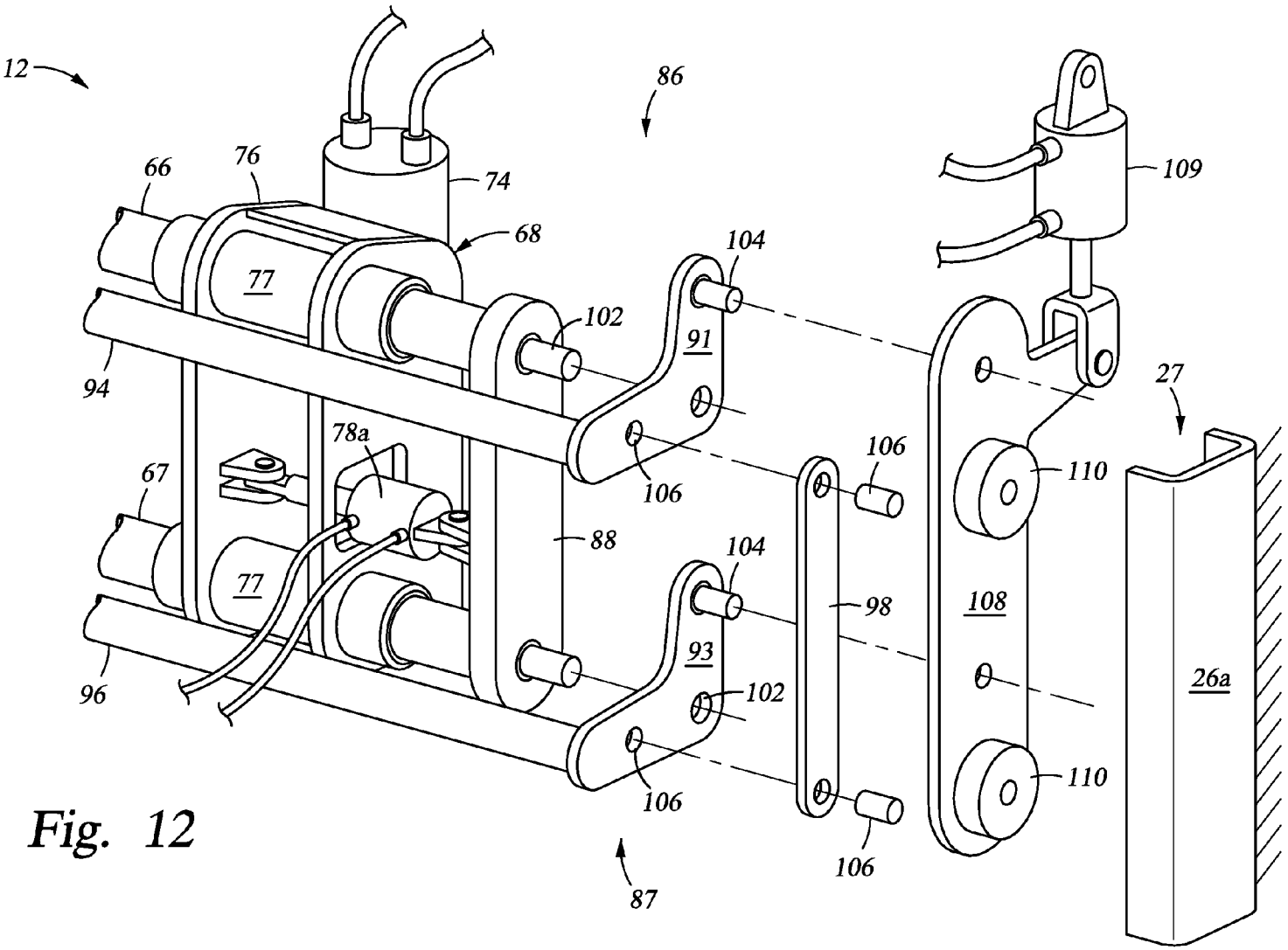
FIG. 12 is a schematic exploded view of a portion of a spinner comprising a zero-side-load device according to one or more aspects of the present disclosure.
Figure 13:
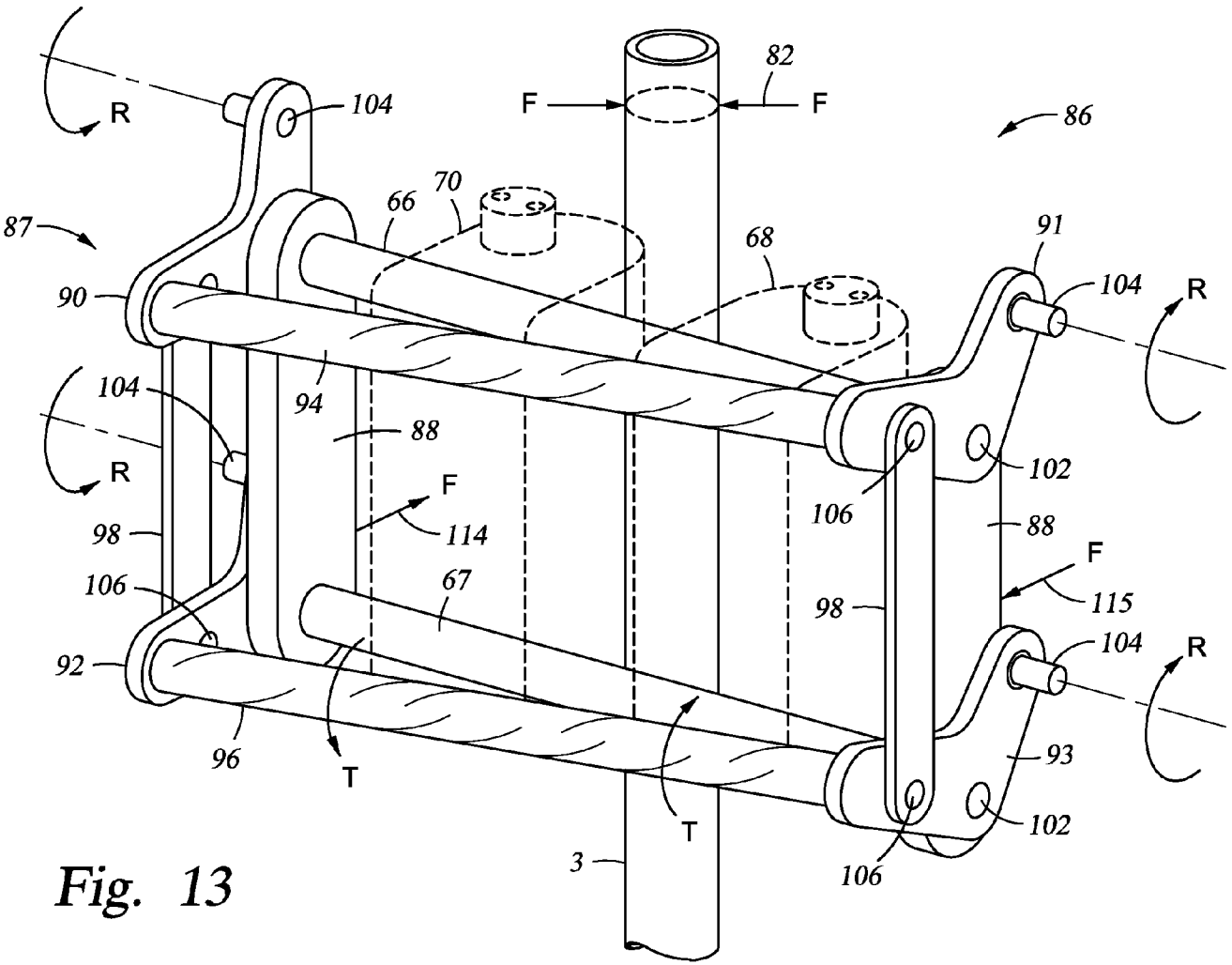
FIG. 13 is a schematic illustration of a spinner comprising a zero-side-load device according to one or more aspects of the present disclosure.
Figure 14:
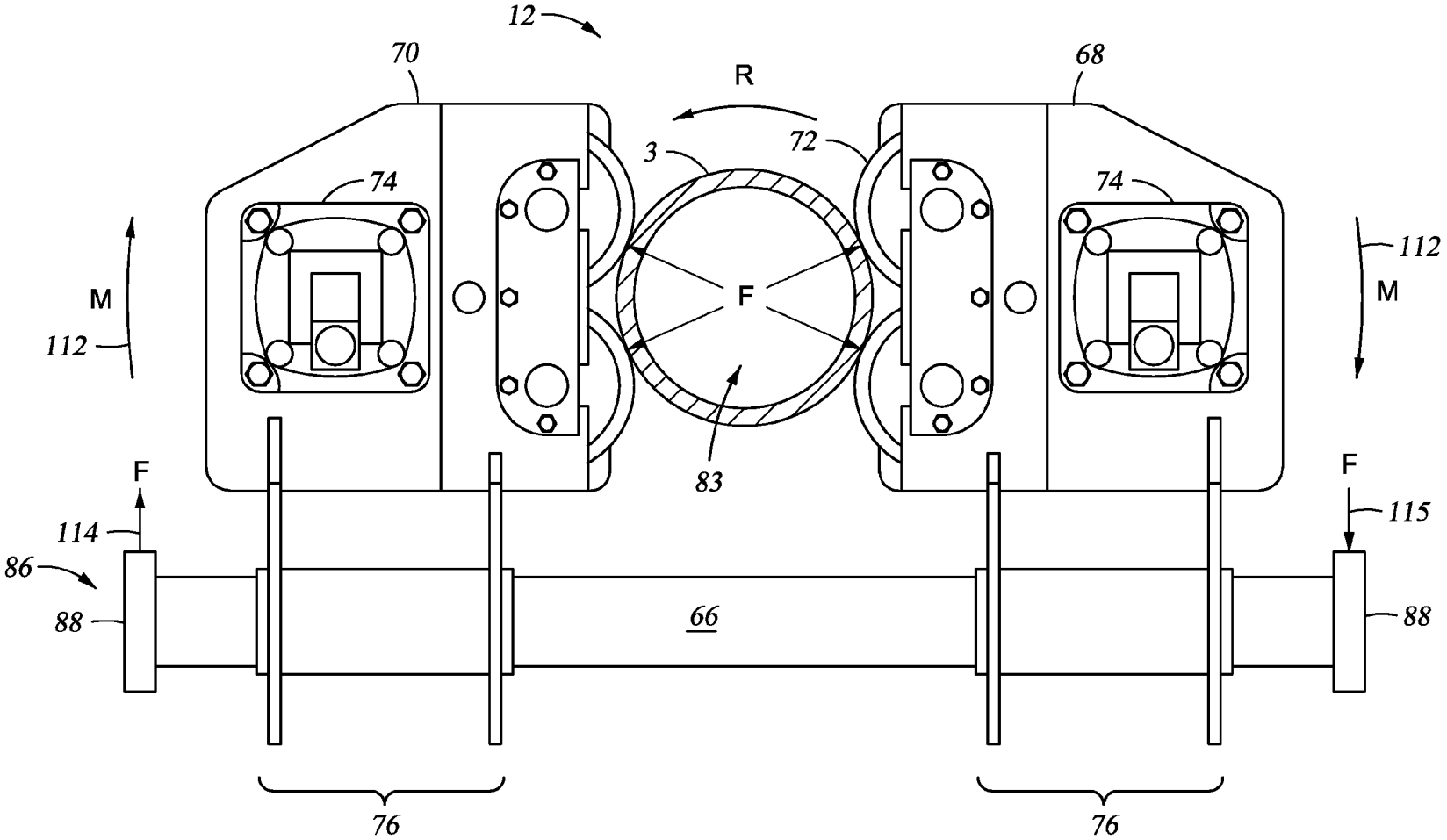
FIG. 14 is a schematic plan view of a spinner comprising a zero-side-load device according to one or more aspects of the present disclosure.

FIG. 12 is a perspective, exploded view of a portion of a spinner 12 comprising a ZSL device, generally denoted 86, according to one or more aspects of the present disclosure. FIGS. 13 and 14 are schematic views of ZSL spinner 12 according to one or more aspects of the present disclosure. The depicted ZSL spinner 12 is adapted from a slider-type spinner as illustrated in FIGS. 9-11. ZSL device 86 is depicted as a bell crank type of apparatus in FIGS. 12 and 13. FIG. 12 is a view from the right, back, relative to access to the tubulars, of the right side of spinner 12. Other types of spinners may be adapted in accordance to one or more aspects of the present disclosure.

ZSL spinner 12 may include one actuator 78 or more actuators to move the spinner assemblies 68 into contact with the tubulars. In the depicted example, ZSL spinner includes two actuators illustrated by actuator 78*a* connected to assembly 68. Actuator 78*a* and its counterpart actuator (not shown) are adapted to each push the respective assembly into contact with the tubular to be spun. Hydraulic actuators are more efficient when pushing than when pulling, thus it may be desired to utilize push actuators to increase the clamping force of the rollers on the tubular.

The embodiments of ZSL spinner 12 depicted in FIGS. 1, 2 and 12-14 in particular, ZSL spinner 12 is connected to cassette 26 (e.g., frame) above tong assembly 20 (FIGS. 1 and 2) and it is not attached to either of wrenches 14, 16. It is common in prior systems for the spinner to be connected to at least one of the power wrench or the back-up wrench. According to one or more aspects of the present disclosure, wrenches 14, 16 transmit torque into each other but neither transmits torque into the cassette; and spinner 12 transmits torque into cassette 26 but does not transmit torque into torque wrench 14 or back-up wrench 16.

ZSL device 86 comprises bell cranks 90, 91, 92, 93; elongated torque members 94, 96 (e.g., struts, tubes, rods etc.); synchronizing link 98 and reaction member 108 (e.g., plate). Each bell crank comprises three pivot connections (e.g., pivot points) identified respectively as inboard pivot connection 102, outboard pivot connection 104 and synchronizing connection 106. Bell cranks 90, 91, 92, and 93, synchronizing link 98 and elongated torque members 94, 96 form a ZSL, or torque, frame 87 (FIG. 13). Torque frame 87 comprises a substantially rectangular frame (e.g., parallelogram structure) having bell cranks 90, 91, 92, and 93 positioned at the corners by longitudinal torque members 94, 96 and vertical synchronizing links 98. Torque frame 87 may be substantially rigid in that the bell cranks are maintained in a constant spaced relationship to one another. In the depicted embodiment, slide rods 66, 67 are capped with a plate 88. Torque frame 87 pivotedly connects spinner 12 via the spinner's frame (e.g., slide members 66, 67) with cassette 26 in the depicted embodiment, which may be connected to carrier 28 (FIGS. 1 and 2).

Reaction plate 108 may include rollers 110 adapted to be disposed in channel 27 of cassette side rails 26*a* for vertical movement within cassette 26. An actuator 109 is connected to reaction plate 108 to suspend reaction plate 108 and spinner 12, for example from cassette 26 (FIG. 1)), for thread compensation during make-up and break-out. Other actuating devices may be utilized, including springs and/or counter weights. In this embodiment, reaction plate 108 is connected at outboard pivot connections 104 (e.g., torque reaction axis) of ZSL device 86.

Torque member 94 is connected between upper bell cranks 90, 91 longitudinally spacing the bell cranks apart. Torque member 96 is similarly connected between bell cranks 92, 93 longitudinally spacing them apart. A synchronizing link 98 is connected between pivot connections 106 of bell crank 90 and bell crank 92 spacing the bell cranks vertically apart. Similarly, a synchronizing link 98 is connected between pivot connections 106 of bell cranks 91 and 93. Each bell crank is connected to a respective reaction plate 108 at outboard pivot connection 104. On the right side depicted in FIG. 13, cap plate 88 is connected between bell cranks 91, 93 at the respective inboard pivot connections 102. Similarly, on the right side a cap plate 88 connects bell crank 91 and bell crank 92 at the respective inboard pivot connections.

An example of operation of ZSL spinner 12 is now described with reference to FIGS. 12-14. Assemblies 68, 70 are actuated laterally along members 66, 67 to engage rollers 72 on tubular 3. In the depicted spinner, the torque on tubular 3 is exerted on rollers 110 of reaction plate 108 as opposed to reacting member 80 in FIG. 11. In other words, the torque reaction axis is at outboard pivot connections 104. Moments, designated 112 in FIG. 14, are taken up by a pair of equal and opposite longitudinal forces 114, 115.

ZSL spinner 12 is float complaint in the embodiments depicted in FIGS. 1, 2 12 and 13, meaning that spinner 12 is capable of moving fore and aft for alignment with the tubular. Inboard pivot connection 102 hangs under outboard pivot connection 104, due to gravity. Synchronizing link 98 connected at pivot connections 106 is in compression and may keep the assembly from pitching forward. Rotation of bell cranks 90, 91, 92, 93 allows for longitudinal compliance. Gravity moves spinner 12 back to a nominal centered position. The torque frame 87 provided by the connection of torque members 94, 96 with the respective bell cranks 90, 91 and 92, 93 prevent unsynchronized movement of members 88 (interconnecting members 66, 67). If a force 114 and 115 occurs, the motion may be canceled by torque member 94 or 96 in torsion as depicted in FIG. 13. Note that FIG. 13 is exaggerated for purposes of description. Because reaction forces 114, 115 cancel the longitudinal components of one another, while cancelling moments 112, the balanced normal loads on rollers 72 are retained whether statically clamping tubular 3 or spinning tubular 3 under heavy torque loads. With equal torque being applied to each roller 72, and equal normal loads applied to tubular 3 through all rollers 72, the efficiency of spinner 12 is improved over standard torque reaction devices.

An apparatus for making and/or breaking a threaded connection between a first tubular and a second tubular according to one or more aspects of the present disclosure may include a spinner operable to spin the first tubular relative to the second tubular; a zero-side-load ("ZSL") device operable to relieve the transverse force induced on the threaded connection in response to the spinner spinning the first tubular; a torque wrench operable to rotate the first tubular relative to the second tubular; and a back-up wrench operable to grip the second tubular.

The back-up wrench may be operable to grip the second tubular with a first grip pressure when the spinner is spinning the first tubular and operable to grip the second tubular at a second grip pressure when the torque wrench is rotating the first tubular. The first grip pressure and the second grip pressure may be the same pressure. The apparatus may include a torsion device connected to the torque wrench and the back-up wrench The torque wrench may be a continuous wrench. The torque wrench may be operable to rotate the first tubular more than about 180 degrees relative to the second tubular without releasing the grip of the torque wrench on the first tubular. The torque wrench may be operable to rotate the first tubular more than about 270 degrees relative to the second tubular without releasing the grip of the torque wrench on the first tubular.

The ZSL device may pivotedly connect the spinner to an external frame. The external frame may be a cassette. The ZSL device may comprise a parallelogram structure having bell cranks positioned at four corners. For example, two pairs of top bell cranks may be spaced apart longitudinally and the bell cranks of each pair may be vertically spaced apart. Each bell crank may comprise a first pivot point, a second pivot point and a third pivot point. The first pivot point may be pivotedly connected to the spinner and the second pivot point may be pivotedly connected to an external frame. A link may be connected to the third pivot point of the respective vertically spaced apart bell cranks. An elongated member may connect to the respective laterally spaced apart bell cranks.

Another example of an apparatus for making and/or breaking a threaded connection between a first and a second tubular according to one or more aspects of the present disclosure may include a spinner operable to spin the first tubular relative to the second tubular; a torque wrench; a back-up wrench; and a torsion device connected to the torque wrench and the back-up wrench, wherein the torsion device is operable to relieve a transverse force induced by rotating the torque wrench and first tubular relative to the back-up wrench and the second tubular from acting on the threaded connection.

The torsion device may comprise a pair of struts pivotedly connected to the torque wrench and the back-up wrench by a pair of bell cranks. The back-up wrench is operable to grip the second tubular with a first grip pressure when the spinner is spinning the first tubular and operable to grip the second tubular at a second grip pressure when the torque wrench is rotating the first tubular.

The apparatus may comprise a zero-side-load ("ZSL") device connected to the spinner. The ZSL device comprises a parallelogram structure having bell cranks positioned at the corners. The ZSL device is pivotedly connected to the spinner and an external frame.

The ZSL device may comprise a parallelogram structure having bell cranks positioned at each corner, each bell crank comprising a first pivot point, a second pivot point and a third pivot point. The first pivot point may be pivotedly connected to the spinner and the second pivot point may be pivotedly connected to an external frame. A link may be connected to the third pivot point of the respective vertically spaced apart bell cranks. An elongated member may connect to the respective laterally spaced apart bell cranks.

The back-up wrench may be operable to grip the second tubular with a first grip pressure when the spinner is spinning the first tubular and operable to grip the second tubular at a second grip pressure when the torque wrench is rotating the first tubular.

An example of a method for making-up a threaded connection between a first tubular and a second tubular according to one or more aspects of the present disclosure may comprise providing a tubular joining device comprising a spinner, a torque wrench and a back-up wrench; gripping the second tubular with the back-up tong; spinning the first tubular via the spinner to advance the pin relative to the box; relieving a transverse force induced on the threaded connection in response to spinning the first tubular; gripping the first tubular with the torque wrench; and rotating the first tubular with the torque wrench to complete the threaded connection.

Relieving (e.g., preventing, reducing, eliminating, minimizing) a transverse force may comprise connecting a zero-side-load ("ZSL") device to the spinner. Relieving a transverse force may comprise connecting a zero-side-load ("ZSL") device to the spinner and a cassette, wherein the ZSL device may comprise a parallelogram structure, for example, comprising bell cranks positioned at each corner, each bell crank comprising a first pivot point, a second pivot point and a third pivot point, wherein the first pivot point is pivotedly connected to the spinner and the second pivot point is pivotedly connected to the cassette; a link connected to the third pivot point of the respective vertically spaced apart bell cranks; and an elongated member connected to the respective laterally spaced apart bell cranks.

Rotating the first tubular with the torque wrench may comprise relieving a transverse force induced on the threaded connection in response to rotating the torque wrench relative to the back-up wrench.

Gripping the second tubular with the back-up tong may comprise gripping the box end of the second tubular with a first gripping pressure when spinning the first tubular with the spinner; and gripping the box end of the second tubular with a second gripping pressure when rotating the first tubular with the torque wrench.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus for making and/or breaking a threaded connection between a first tubular and a second tubular comprising:

a spinner operable to spin the first tubular relative to the second tubular;

a zero-side-load ("ZSL") device operable to relieve the transverse force induced on the threaded connection in response to the spinner spinning the first tubular;

a torque wrench operable to rotate the first tubular greater than about 180 degrees relative to the second tubular without releasing the grip of the torque wrench on the first tubular; and a back-up wrench operable to grip the second tubular.

2. The apparatus of claim 1, wherein the back-up wrench is operable to grip the second tubular with a first grip pressure when the spinner is spinning the first tubular and operable to grip the second tubular at a second grip pressure when the torque wrench is rotating the first tubular.

3. The apparatus of claim 1, further comprising a torsion device connected to the torque wrench and the back-up wrench, the torsion device operable to relieve a transverse force induced on the threaded connection in response to rotating the torque wrench relative to the back-up wrench.

4. The apparatus of claim 1, wherein the ZSL device pivotedly connects the spinner to an external frame.

5. The apparatus of claim 4, wherein the external frame is a cassette.

6. The apparatus of claim 1, wherein the ZSL device comprises a parallelogram structure having bell cranks positioned at four corners.

7. The apparatus of claim 6, wherein the ZSL device connects the spinner to an external frame.

8. The apparatus of claim 1, wherein the ZSL device comprises:

a parallelogram structure having bell cranks position at each corner, each bell crank of the ZSL device comprising a first pivot point, a second pivot point and a third pivot point, wherein the first pivot point is pivotedly connected to the spinner and the second pivot point is pivotedly connected to an external frame;

a link connected to the third pivot point of the respective vertically spaced apart bell cranks; and an elongated member connected to the respective laterally spaced apart bell cranks.

9. An apparatus for making and/or breaking threaded connections between a first and a second tubular comprising:

a spinner operable to spin the first tubular relative to the second tubular;

a torque wrench operable to rotate the first tubular greater than about 180 degrees relative to the second tubular without releasing the grip of the torque wrench on the first tubular;

a back-up wrench; and a torsion device connected with the torque wrench and the back-up wrench, wherein the torsion device is operable to relieve a transverse force induced in response to rotating the torque wrench relative to the back-up wrench.

10. The apparatus of claim 9, wherein the torsion device comprises a pair of struts pivotedly connected to the torque wrench and the back-up wrench by a pair of bell cranks.

11. The apparatus of claim 9, wherein the back-up wrench is operable to grip the second tubular with a first grip pressure when the spinner is spinning the first tubular and operable to grip the second tubular at a second grip pressure when the torque wrench is rotating the first tubular.

12. The apparatus of claim 11, wherein the torsion device comprises a pair of struts pivotedly connected to the torque wrench and the back-up wrench by a pair of bell cranks.

13. The apparatus of claim 9, further comprising a zero-side-load ("ZSL") device connected to the spinner.

14. The apparatus of claim 13, wherein the ZSL device comprises a parallelogram structure having bell cranks positioned at the corners.

15. The apparatus of claim 14, wherein the ZSL device is pivotedly connected to the spinner and an external frame.

16. The apparatus of claim 13, wherein the back-up wrench is operable to grip the second tubular with a first grip pressure when the spinner is spinning the first tubular and operable to grip the second tubular at a second grip pressure when the torque wrench is rotating the first tubular.

17. The apparatus of claim 13, wherein the ZSL device comprises:

a parallelogram structure having bell cranks positioned at each corner, each bell crank comprising a first pivot point, a second pivot point and a third pivot point, wherein the first pivot point is pivotedly connected to the spinner and the second pivot point is pivotedly connected to an external frame;

a link connected to the third pivot point of the respective vertically spaced apart bell cranks; and an elongated member connected to the respective laterally spaced apart bell cranks.

18. The apparatus of claim 17, wherein the back-up wrench is operable to grip the second tubular with a first grip pressure when the spinner is spinning the first tubular and operable to grip the second tubular at a second grip pressure when the torque wrench is rotating the first tubular.

19. A method for making-up a threaded connection between a first tubular and a second tubular, comprising:

gripping the second tubular with a back-up wrench of a tubular joiner device comprising a spinner, a torque wrench and the back-up wrench;

spinning the first tubular via the spinner to advance a pin of the first tubular relative to a box of the second tubular;

gripping the first tubular with the torque wrench;

rotating the first tubular greater than about 180 degrees without releasing the grip of the torque wrench on the first tubular to complete the threaded connection; and relieving a transverse force induced on the threaded connection in response to spinning the first tubular.

20. The method of claim 19, wherein the relieving a transverse force comprises a zero-side-load ("ZSL") device connected to the spinner.

21. The method of claim 19, wherein the relieving a transverse force comprises a zero-side-load ("ZSL") device connected to the spinner and a cassette, the ZSL device comprising:

a parallelogram structure comprising bell cranks positioned at each corner, each bell crank comprising a first pivot point, a second pivot point and a third pivot point, wherein the first pivot point is pivotedly connected to the spinner and the second pivot point is pivotedly connected to the cassette;

a link connected to the third pivot point of the respective vertically spaced apart bell cranks; and an elongated member connected to the respective laterally spaced apart bell cranks.

22. The method of claim 19, wherein the rotating the first tubular with the torque wrench comprises relieving a transverse force induced on the threaded connection in response to rotating the torque wrench relative to the back-up wrench.

23. The method of claim 19, wherein the gripping the second tubular with the back-up wrench comprises:

gripping the box end of the second tubular with a first gripping pressure when spinning the first tubular with the spinner; and gripping the box end of the second tubular with a second gripping pressure when rotating the first tubular with the torque wrench.

24. The method of claim 23, wherein the relieving a transverse force comprises a zero-side-load ("ZSL") device connected to the spinner and a cassette, the ZSL device comprising:

a parallelogram structure comprising bell cranks positioned at each corner, each bell crank comprising a first pivot point, a second pivot point and a third pivot point, wherein the first pivot point is pivotedly connected to the spinner and the second pivot point is pivotedly connected to the cassette;

a link connected to the third pivot point of the respective vertically spaced apart bell cranks; and an elongated member connected to the respective laterally spaced apart bell cranks.

25. The method of claim 24, wherein the rotating the first tubular with the torque wrench comprises relieving a transverse force from being induced on the threaded connection in response to rotating the torque wrench relative to the back-up wrench.

26. An apparatus for making and/or breaking a threaded connection between a first tubular and a second tubular, comprising:

a spinner operable to spin the first tubular relative to the second tubular;

a zero-side-load ("ZSL") device operable to relieve the transverse force induced on the threaded connection in response to the spinner spinning the first tubular;

a torque wrench rotate the first tubular relative to the second tubular; and a back-up wrench grip the second tubular:

wherein the ZSL device comprises:

a parallelogram structure having bell cranks positioned at each corner, each bell crank comprising a first pivot point, a second pivot point and a third pivot point, wherein the first pivot point is pivotedly connected to the spinner and the second pivot point is pivotedly connected to an external frame;

a link connected to the third pivot point of the respective vertically spaced apart bell cranks; and an elongated member connected to the respective laterally spaced apart bell cranks.

27. The apparatus of claim 26, further comprising a torsion device comprising a pair struts pivotedly connected to the torque wrench and the back-up wrench by a pair of bell cranks.

28. An apparatus for making and/or breaking threaded connections between a first and a second tubular comprising:

a spinner operable to spin the first tubular relative to the second tubular;

a torque wrench;

a back-up wrench; and a torsion device connected to the torque wrench and the back-up wrench to relieve a transverse force induced in response to rotating the torque wrench relative to the back-up wrench, wherein the torsion device comprises:

a span member pivotedly connected at a first end to a first bell crank and pivotedly connected at a second end to a second bell crank;

a first lateral strut pivotedly connected to the first bell crank and pivotedly connected to the back-up wrench;

a second lateral strut pivotedly connected to the second bell crank and pivotedly connected to the back-up wrench; and a post extending vertically from the torque wrench, the post connected to the span member between the pair of bell cranks.

* * * * *